US006073980A

United States Patent [19]

Arabia, Jr. et al.

[11] Patent Number: 6,073,980

[45] Date of Patent: Jun. 13, 2000

[54] STRIKER ASSEMBLY FOR VEHICLE DOOR LATCH

[75] Inventors: Frank Joseph Arabia, Jr., Macomb Township, Macomb County; Michael Todd Moury, Shelby Township, Macomb County; Donald Michael Perkins, Rochester Hills, all of Mich.

[73] Assignee: General Motors Corporation, Detroit, Mich.

[21] Appl. No.: 09/233,973

[22] Filed: Jan. 20, 1999

[51] Int. Cl.[7] ..... E05B 15/02

[52] U.S. Cl. ..... 292/340; 292/216; 292/341.12

[58] Field of Search ..... 292/340, 341.11, 292/341.12, 216, DIG. 53; 400/271, 325

[56] References Cited

U.S. PATENT DOCUMENTS

| | | | |
|---|---|---|---|
| 1,780,675 | 11/1930 | Hewitt | 411/271 |
| 4,466,645 | 8/1984 | Kobayashi | 292/341.12 |
| 4,650,231 | 3/1987 | Shimura et al. | 292/340 |
| 4,777,812 | 10/1988 | Haugen | 70/232 |
| 4,896,908 | 1/1990 | Kleefeldt | 292/216 |
| 4,911,488 | 3/1990 | Brackmann et al. | 292/216 |
| 4,941,696 | 7/1990 | Yamada et al. | 292/340 |
| 4,981,313 | 1/1991 | Makamura | 292/340 |
| 4,998,759 | 3/1991 | Peterson et al. | 292/340 |
| 5,050,917 | 9/1991 | Hamada et al. | 292/340 |
| 5,125,698 | 6/1992 | Thau | 292/216 |
| 5,209,532 | 5/1993 | Nakamura et al. | 292/216 |
| 5,316,354 | 5/1994 | Arabia, Jr. et al. | 292/340 |
| 5,501,495 | 3/1996 | Claucherty | 292/340 |
| 5,529,356 | 6/1996 | Cetnar | 292/340 |
| 5,785,365 | 7/1998 | Lorey | 292/216 |

FOREIGN PATENT DOCUMENTS

| | | | |
|---|---|---|---|
| 2423607 | 12/1979 | France | 292/216 |

*Primary Examiner*—B. Dayoan
*Assistant Examiner*—Clifford B Vaterlaus
*Attorney, Agent, or Firm*—Kathryn A. Marra

[57] ABSTRACT

A striker assembly for a door latch comprises a U-shaped bracket and a striker pin. The U-shaped bracket comprises a base plate of substantial width and height and a narrow generally L-shaped strap that is integrally attached to the side of the base plate and that has an end portion spaced from the base plate. The striker pin has an enlarged head that bottoms in a through hole of the base plate, a threaded shank end that screws into an end of the strap and a collar adjacent the threaded end for transferring longitudinal loads from the door latch to the base plate.

12 Claims, 1 Drawing Sheet

STRIKER ASSEMBLY FOR VEHICLE DOOR LATCH

BACKGROUND OF THE INVENTION

This invention relates to vehicle door latches and more particularly to a striker assembly that is attached to a vehicle door jamb pillar and engaged by a door latch when a vehicle door is closed.

Automotive vehicles are typically equipped with a door latch in the end of each door that engages a striker assembly that is secured to the confronting face of a vehicle door jamb pillar at the edge of the door opening. The latch, particularly one for a swinging door, has a fishmouth slot that opens toward the vehicle interior and extends through a cutout in the face plate of the latch. This fishmouth slot guides a striker pin or projection into the interior of the door latch as the vehicle door is closed. As the striker pin travels into the fishmouth slot, it "strikes" or engages an internal, pivotally mounted fork bolt lever that is part of a latching mechanism that is inside the latch housing. The striker pin then rotates the fork bolt lever to a latched position where a portion of the fork bolt lever wraps around the striker pin and closes off the fishmouth slot. The fork bolt lever is typically held in the latched position by a detent lever or pawl that is released by a door handle when the door is opened.

Modern door latch striker assemblies now generally comprise a striker pin that is attached to a bracket usually by a peening operation with the bracket being adapted for attachment to the door jamb pillar. See for instance U.S. Pat. No. 4,941,696 Yamada et al; U.S. Pat. No. 4,981,313 Makamura; U.S. Pat. No. 4,998,759 Peterson et al and U.S. Pat. No. 5,050,917 Hamada et al.

Strap type striker assemblies are also known. These striker assemblies comprise a striker pin that is attached to a door jamb pillar by a U-shaped bracket. The bracket has a substantial base plate and a narrow L-shaped strap that is integrally attached to one side of the base plate. The striker pin has a head that bottoms in a hole in the base plate and a shank that extends through a concentric hole in the end of the narrow strap. The end of the shank is peened to secure the striker pin to the bracket. The head may be preformed or formed in situ at the same time that the shank end is peened.

These prior art strap type striker assemblies have a limited capacity to resist longitudinal loads by the vehicle door latch, particularly the latch bolt lever pulling against the end of the strap which is narrow and punched to provide the concentric hole for the end of the pin shank.

SUMMARY OF THE INVENTION

The object of this invention is to provide an improved strap type striker assembly for a vehicle door latch.

A feature of the invention is that the strap type striker assembly has a striker pin that has a collar for transferring longitudinal loads from a vehicle door latch or latch bolt lever to the strong base plate of the bracket.

An optional feature of the invention is that the strap type striker assembly may have a striker pin that is screwed into a threaded hole in an end of the strap to facilitate manufacture.

Another optional feature of the invention is that the strap type striker assembly may have a striker pin that is screwed into a threaded hole in an end of the strap and then spun flat to secure the threaded end of the shank in the threaded hole of the strap tightly.

Yet another optional feature of the invention is that the bracket plate and the striker pin can be made of steel and through hardened before assembly for manufacturing economy.

Still yet another optional feature of the invention is that the striker pin can be through hardened and insert molded with a sound deadening plastic sleeve before assembly to a through hardened bracket.

BRIEF DESCRIPTION OF THE DRAWINGS

The above and other objects, features and advantages of the invention will become more apparent from the following description taken in conjunction with the accompanying drawings wherein like references refer to like parts and wherein.

DETAILED DESCRIPTION OF THE PREFERRED EMBODIMENT

Figure 3:
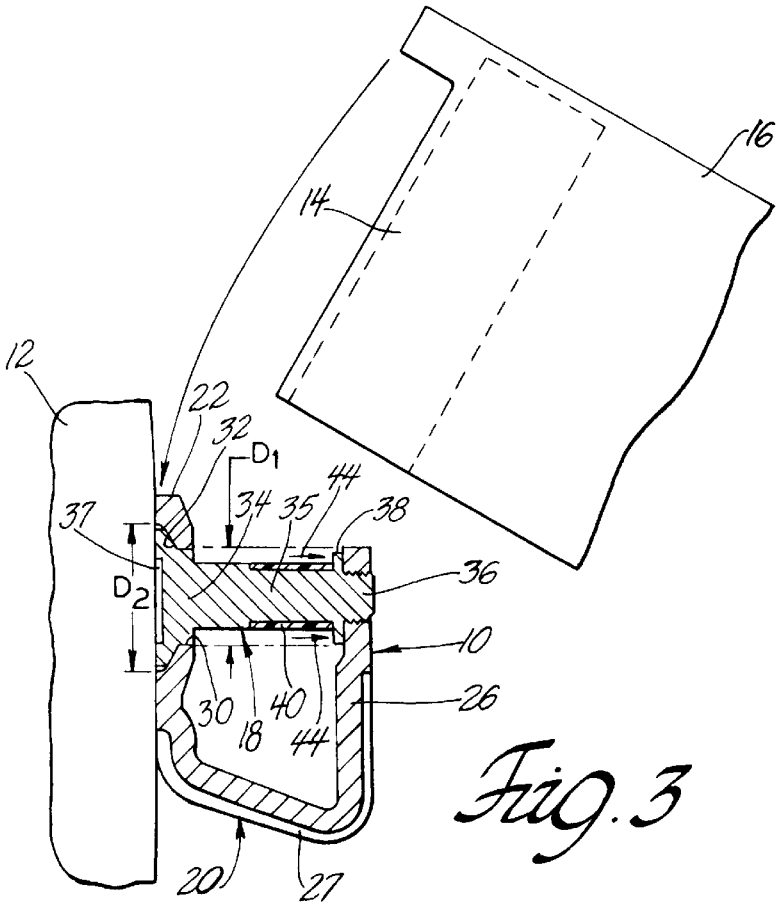
FIG. 3 is a section view taken substantially along the line 3—3 of FIG. 1 showing the striker assembly in relation to a partially open vehicle door.

Referring now to the drawing, the striker assembly 10 of the invention is illustrated as being mounted on the face of a vehicle door jamb pillar 12 to cooperate with a vehicle door latch 14 that is mounted on the free end of a swinging vehicle door 16 schematically illustrated in FIG. 3.

The door latch 14 has a fishmouth slot that opens toward the vehicle interior and extends through a corresponding cutout in a face plate of the door latch 14. This fishmouth slot guides the striker pin 18 of assembly 10 into the interior of the door latch 14 as the vehicle door is closed. The striker pin 18 "strikes" or engages an internal, pivotally mounted fork bolt lever as it is guided into the fishmouth slot and rotates the fork bolt lever to a latched position where the fork bolt lever wraps around an outside portion of striker pin 18 and closes off the fishmouth slot behind the striker pin 18. The fork bolt lever is held in the latched position by a detent lever or pawl that is released by a door handle when the door is opened.

Striker assembly 10 is a strap type striker assembly that includes a generally U-shaped bracket for securing striker pin 18 to door jamb pillar 12. Striker pin 18 is attached to the U-shaped bracket 20 that is secured to door jamb pillar 12 by bolts 24 that extend through a pair of vertically spaced bolt holes that extend through base plate 22. Base plate 22 is not subject to strict space limitations and consequently base plate 22 has substantial height and width to provide a strong base for absorbing longitudinal loads.

Figure 1:
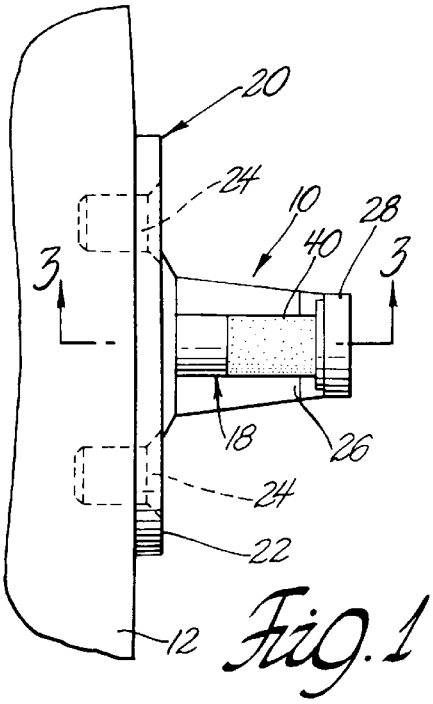
FIG. 1 is a partial front view of a passenger side front door area of an automotive vehicle taken from an exterior side of the automotive vehicle showing a striker assembly of the invention fastened to the door jamb pillar of the vehicle.
Figure 2:
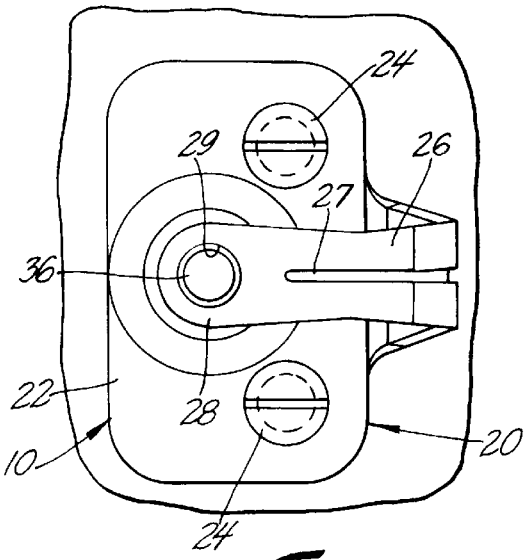
FIG. 2 is a side view of the striker assembly and door jamb pillar shown in FIG. 1.

Bracket 20 also has a narrow generally L-shaped strap 26 that is integrally attached to a vertical side of the base plate 22 and that may include a stiffening bead 27. Strap 26 has a substantially reduced height in comparison to the height of base plate 24 to meet space requirements for striker assembly 10. The height of strap 26 is about one-third of the height of base plate 22 with the maximum height occurring at the integral attachment of the side of the base plate as best shown in FIGS. 1 and 2.

Strap 26 has an end portion 28 that is spaced from base plate 22 in a longitudinal direction into the door opening, that is toward the front of the vehicle. Base plate 22 has a through hole 30 that narrows in the longitudinal direction toward the end portion 28 of the strap 26. As best shown in FIG. 3, through hole 30 has a diameter $D_1$ at a front surface of the base plate and another diameter $D_2$ at a rear surface of the base plate that is larger than the diameter $D_1$ at the front surface. Hole 30 also includes an internal tapered or conical shoulder 32 between the diameters.

The end portion 28 of the strap 26 has a threaded hole 29 that is concentric with the through hole 30 of the base plate. End portion 28 is the narrowest portion of strap 28 and must be narrow enough to fit into latch 14 when vehicle door 16 is closed.

Striker pin 18 has an enlarged head 34 at one end of shank 35 that is disposed in through hole 30. Head 34 has a similar shape and engages shoulder 32 in through hole 30 of the base plate 22 to prevent pull-through in the longitudinal direction. Shank 35 has a threaded end 36 and a collar 38 adjacent the threaded end 36. Collar 38 has an outer diameter that is substantially equal to or less than the diameter $D_1$ at the front surface of the base plate 22 so that collar 38 passes through through hole 30 during assembly. Striker pin 18 is attached to bracket 20 by inserting the threaded end 36 of shank 35 through through hole 30 and then screwing the threaded end 36 into the threaded hole of the strap end 28 until collar 38 engages strap end 28 and head 34 bottoms out against shoulder 32 in through hole 30. Head 34 may include a slot 37 or the like to facilitate the screw in attachment of striker pin 18 to bracket 20. Threaded end 36 is preferably sized to extend past the outer surface of strap end 28 by about 0.20 to 0.30 mm as shown in dashed lines in FIG. 3. The protruding end can then be peened orbitally until it is flush with the outer surface of strap end 28 causing the threads to swell and secure threaded end 36 in threaded hole 29 tightly.

Base plate 20 has a rear planar surface and the enlarged head 34 of striker pin 18 has a rear planar surface that are substantially coplanar when the enlarged head 34 engages the shoulder 32 in through hole 30 of the base plate 22 so that the striker pin cannot move out of the through hole 30 of the base plate 22 when the striker assembly 10 is secured to doorjamb pillar 12 as best shown in FIG. 3.

The installed striker assembly 10 is subjected to longitudinal loads from the door latch 14 as indicated by the arrows 44 in FIG. 3. These loads can be quite high in a collision, particularly in a side impact collision. In prior art constructions longitudinal loads 44 acted directly on strap end 28 which has limited strength because it is necessarily narrow and interrupted by hole 29. However, in the striker assembly 10 of the invention, longitudinal loads 44 act on collar 38 which transfers the load to base plate 22 which is very strong because it does not have strict space requirements and can be made relatively large as shown in FIGS. 1, 2 and 3.

The end of shank 35 can be attached to strap end 28 in any suitable manner, such as by peening or welding. However, the screw in attachment discussed above is preferable because the striker pin 18 and the bracket 20 can both then be made of steel and through hardened separately. The through hardened striker pin 18 and bracket 20 can then be assembled and secured together easily because metal need not be displaced or alternatively very little metal need be displaced from the shank end of striker pin 18 if the flush peening option is chosen.

The screw in attachment also facilitates the inclusion of a sound deadening plastic sleeve 40 on striker pin 18 which can simply be insert molded on striker pin 18 after striker pin 18 is through hardened and before striker pin 18 is attached to bracket 20.

Obviously, many modifications and variations of the present invention in light of the above teachings may be made. It is, therefore, to be understood that, within the scope of the appended claims, the invention may be practiced otherwise than as specifically described.

What is claimed is:

1. A striker assembly for a vehicle door latch comprising:

a generally U-shaped bracket and a striker pin that is attached to the U-shaped bracket, the bracket having a base plate of substantial width and height that is adapted to be secured to a door jamb pillar of an automotive vehicle, the bracket also having a generally L-shaped strap of substantially reduced height that is integrally attached to a vertical side of the base plate, and that has an end portion that is spaced from the base plate in a longitudinal direction, the base plate having a through hole that includes an internal shoulder, the end portion of the strap having a hole that is concentric with the through hole of the base plate, the striker pin having a shank and an enlarged head at one end of the shank engaging the shoulder in the through hole of the base plate to prevent pull-through in the longitudinal direction, and the shank having a collar adjacent an opposite end of the shank that extends radially outwardly of the shank, the opposite end of the shank being secured in the hole of the strap end with the collar extending radially outwardly of the shank and spaced from the base plate whereby the collar transfers longitudinal loads from the vehicle door latch to the base plate.

2. A striker assembly for a vehicle door latch comprising:

a generally U-shaped bracket and a striker pin that is attached to the U-shaped bracket, the bracket having a base plate of substantial width and height that is adapted to be secured to a door jamb pillar of an automotive vehicle.

the bracket also having a generally L-shaped strap of substantially reduced height that is integrally attached to a vertical side of the base plate, and that has an end portion that is spaced from the base plate in a longtudinal direction, the base plate having a through hole that includes an internal shoulder, the end portion of the strap having a hole that is concentric with the through hole of the base plate, the striker pin having a shank and an enlarged head at one end of the shank engaging the shoulder in the through hole of the base plate to prevent pull-through in the longitudinal direction, the shank having a collar adjacent an opposite end of the shank that extends radially outwardly of the shank, the opposite end of the shank being secured in the hole of the strap end with the collar extending radially outwardly of the shank and spaced from the base plate whereby the collar transfers longitudinal loads from the vehicle door latch to the base plate, and the opposite end of the shank and the hole of the strap end being threaded and the opposite end of the shank being screwed into the hole of the strap end.

3. The striker assembly as defined in claim 2 wherein the striker pin and the bracket are through hardened steel.

4. The striker assembly as defined in claim 3 wherein the striker pin has an insert molded sound deadening plastic sleeve.

5. A striker assembly for a vehicle door latch comprising:

a generally U-shaped bracket and a striker pin that is attached to the U-shaped bracket, the bracket having a base plate of substantial width and height that is adapted to be secured to a door jamb pillar of an automotive vehicle, the bracket also having a generally L-shaped strap of substantially reduced height that is integrally attached to a vertical side of the base plate, and that has an end portion that is spaced from the base plate in a longitudinal direction, the base plate having a through hole that includes an internal shoulder, the end portion of the strap having a hole that is concentric with the through hole of the base plate, the striker pin having an enlarged head at one end engaging the shoulder in the through hole of the base plate to prevent pull-through in the longitudinal direction, the striker pin having a shank end and a collar adjacent the shank end, the shank end being secured in the hole of the strap end whereby the collar transfers longitudinal loads from the vehicle door latch to the base plate, the through hole of the base plate having a diameter at a front surface of the base plate and another diameter at a rear surface of the base plate that is larger than the diameter at the front surface, and the collar having an outer diameter that is no larger than the diameter at the front surface of the base plate so that the collar passes through the through hole during assembly.

6. The striker assembly as defined in claim 5 wherein the base plate has a rear planar surface and the enlarged head of the striker pin has a rear planar surface that are substantially coplanar when the enlarged head engages the shoulder in the through hole of the base plate so that the striker pin cannot back out of the through hole of the base plate when the striker assembly is secured to a door jamb pillar of an automobile.

7. The striker assembly as defined in claim 6 wherein the base plate has a pair of vertically spaced bolt holes for securing the base plate to the door jamb pillar.

8. A striker assembly for a vehicle door latch comprising:

a bracket and a striker pin that is attached to the bracket, the bracket having a base plate that is adapted to be secured to a door jamb pillar of an automotive vehicle, the bracket also having a narrow, generally L-shaped strap that is integrally attached to a vertical side of the base plate, and that has an end portion that is spaced from the base plate in a longitudinal direction, the base plate having a through hole that has an internal shoulder, the end portion of the strap having a threaded hole that is concentric with the through hole of the base plate, the striker pin having an enlarged head at one end that engages the internal shoulder of the through hole of the base plate to prevent pull-through in the longitudinal direction, and the striker pin having a threaded end that is screwed in the threaded hole of the end portion of the strap.

9. The striker assembly as defined in claim 8 wherein the striker pin and the bracket are through hardened steel.

10. The striker assembly as defined in claim 9 wherein the wherein the striker pin has an insert molded, sound deadening plastic sleeve.

11. The striker assembly as defined in claim 8 wherein the threaded end of the striker pin is peened to tighten the threaded engagement of the threaded end of the striker pin with the threaded hole of the end portion of the strap.

12. The striker assembly as defined in claim 8 wherein the striker pin has a radial collar adjacent the threaded end that engages the end portion of the strap.

* * * * *